US011408713B2

(12) United States Patent
Norris

(10) Patent No.: US 11,408,713 B2
(45) **Date of Patent: *Aug. 9, 2022**

(54) ENTANGLING PROJECTILES AND SYSTEMS FOR THEIR USE

(71) Applicant: Wrap Technologies, Inc., Tempe, AZ (US)

(72) Inventor: Elwood Norris, Poway, CA (US)

(73) Assignee: Wrap Technologies, Inc., Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/356,632

(22) Filed: Jun. 24, 2021

(65) Prior Publication Data

US 2022/0074714 A1 Mar. 10, 2022

Related U.S. Application Data

(60) Continuation of application No. 16/825,868, filed on Mar. 20, 2020, now Pat. No. 11,073,363, which is a division of application No. 16/015,932, filed on Jun. 22, 2018, now Pat. No. 10,634,461.

(60) Provisional application No. 62/524,499, filed on Jun. 24, 2017.

(51) Int. Cl.
*F41H 13/00* (2006.01)
*F42B 12/66* (2006.01)

(52) U.S. Cl.
CPC ..... *F41H 13/0006* (2013.01); *F42B 12/66* (2013.01)

(58) Field of Classification Search
CPC ..... F42B 12/66; F42B 12/68; F42B 15/10; F41H 13/0006; F41H 13/0025
See application file for complete search history.

(56) References Cited

U.S. PATENT DOCUMENTS

| | | | | |
|---|---|---|---|---|
| 34,626 A | | 3/1862 | Ely | |
| 34,628 A | | 3/1862 | Gault | |
| 35,734 A | | 6/1862 | Gault | |
| 39,282 A | | 7/1863 | Ganster | |
| 271,825 A | | 2/1883 | Fiske | |
| 347,988 A | | 8/1886 | Boyd | |
| 495,505 A | * | 4/1893 | Martin | F42B 12/66 102/504 |
| 495,506 A | | 4/1893 | Meyrowitz | |
| 1,070,582 A | | 8/1913 | Browning | |

(Continued)

FOREIGN PATENT DOCUMENTS

| | | | |
|---|---|---|---|
| CA | 2162221 | A1 | 5/1996 |
| CN | 104085851 | A | 10/2014 |

(Continued)

*Primary Examiner* — Derrick R Morgan
(74) *Attorney, Agent, or Firm* — Jason Jones

(57) ABSTRACT

An entangling projectile for use with a projectile deployment system includes a pair of pellets. At least one of the pair of pellets has a head with a head outer diameter and a shank with a shank outer diameter, the shank outer diameter being less than the head outer diameter. A tether connects the pair of pellets. A centering shroud is carried by a shank of the at least one of the pair of pellets. The centering shroud has at least one tether opening formed therein to receive the tether. The tether is coupled to the pellet and extends along the shank of the pellet and through the at least one tether opening formed in the centering shroud.

14 Claims, 12 Drawing Sheets

(56) References Cited

U.S. PATENT DOCUMENTS 1,151,070 A 8/1915 Victory
1,165,053 A * 12/1915 Wodiska ..... F42B 12/66 89/14.05
1,198,035 A * 9/1916 Huntington ..... F42B 12/66 102/504
1,211,001 A 1/1917 Steinmetz
1,217,415 A 2/1917 Colomyjczuk
1,229,421 A 6/1917 Downs
1,276,689 A 8/1918 Poudrier
1,304,857 A 5/1919 Davis
1,343,747 A 6/1920 Radakovich
1,488,182 A 3/1924 Whelton
1,536,164 A 5/1925 Tainton
2,354,451 A 7/1944 Forbes
2,368,587 A * 1/1945 Wise ..... F41H 11/04 102/504
2,372,383 A 3/1945 Lee
2,373,363 A * 4/1945 Wellcome ..... F41H 13/0006 102/504
2,373,364 A 4/1945 Wellcome
2,455,784 A 12/1948 Lapsensohn
2,611,340 A 9/1952 Manning
2,668,499 A 2/1954 Mourlaque
2,797,924 A 7/1957 Stewart
2,848,834 A * 8/1958 Cox ..... F42B 12/362 473/582
2,873,974 A * 2/1959 Ramsey ..... F42B 6/04 473/577
3,085,510 A 4/1963 Campbell
3,340,642 A 9/1967 Vasiljevic
3,484,665 A 12/1969 Mountjoy et al.
3,523,538 A 8/1970 Shimizu
3,583,087 A 6/1971 Huebner
3,717,348 A 2/1973 Bowers
3,773,026 A 11/1973 Romero
3,803,463 A 4/1974 Cover
3,831,306 A 8/1974 Gregg
3,921,614 A 11/1975 Fogelgren
4,027,418 A 6/1977 Baldi et al.
4,166,619 A 9/1979 Bergmann et al.
4,193,386 A 3/1980 Rossi
4,253,132 A 2/1981 Cover
4,318,389 A 3/1982 Kiss, Jr.
4,466,417 A 8/1984 Mulot et al.
4,559,737 A 12/1985 Washington
4,615,529 A * 10/1986 Vocal ..... F42B 6/04 473/583
4,656,947 A 4/1987 Gordon et al.
4,664,034 A 5/1987 Christian
4,750,692 A 6/1988 Howard
4,752,539 A 6/1988 Vatter
4,795,165 A * 1/1989 Tehan ..... F42B 6/04 473/578
4,912,867 A 4/1990 Dukes, Jr.
4,912,869 A 4/1990 Govett
4,962,747 A 10/1990 Biller
5,003,886 A 4/1991 Pahnke et al.
5,078,117 A 1/1992 Cover
5,103,366 A 4/1992 Battochi
5,145,187 A 9/1992 Lewis
5,279,482 A 1/1994 Dzenitis et al.
5,314,196 A 5/1994 Ruelle
5,315,932 A 5/1994 Bertram
5,326,101 A 7/1994 Fay
5,372,118 A 12/1994 Schmidt, III et al.
5,396,830 A 3/1995 Kornblith et al.
5,460,155 A * 10/1995 Hobbs, II ..... F42B 12/68 124/56
5,546,863 A * 8/1996 Joslyn ..... F42B 12/68 42/105
5,561,263 A * 10/1996 Baillod ..... F42B 12/66 102/504
5,649,466 A 7/1997 Genovese
5,654,867 A 8/1997 Murray
5,698,815 A 12/1997 Ragner
5,706,795 A 1/1998 Gerwig
5,750,918 A 5/1998 Mangolds et al.
5,782,002 A 7/1998 Reed
5,786,546 A 7/1998 Simson
5,814,753 A 9/1998 Rieger
5,831,199 A 11/1998 McNulty, Jr. et al.
5,898,125 A 4/1999 Mangolds et al.
5,904,132 A 5/1999 Biller
5,943,806 A 8/1999 Underwood
5,962,806 A 10/1999 Coakley et al.
5,996,504 A 12/1999 Lowery
6,283,037 B1 9/2001 Sclafani
6,381,894 B1 5/2002 Murphy
6,382,071 B1 5/2002 Bertani
6,543,173 B1 4/2003 Golan
6,575,073 B2 6/2003 McNulty, Jr. et al.
6,615,622 B2 9/2003 MacAleese et al.
6,636,412 B2 10/2003 Smith
6,729,222 B2 5/2004 McNulty, Jr.
6,820,560 B1 11/2004 Romppanen
6,880,466 B2 4/2005 Carman
6,898,887 B1 5/2005 Stratbucker
7,042,696 B2 5/2006 Smith et al.
7,065,915 B2 6/2006 Chang
7,075,770 B1 7/2006 Smith
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 1/2008 Su
7,327,549 B2 2/2008 Smith et al.
7,360,489 B1 * 4/2008 Han ..... F42B 12/60 102/504
D570,948 S 6/2008 Cerovic et al.
7,409,912 B2 8/2008 Cerovic et al.
7,412,975 B2 8/2008 Dillon, Jr.
7,444,939 B2 11/2008 McNulty et al.
7,444,940 B2 11/2008 Kapeles et al.
D602,109 S 10/2009 Cerovic et al.
7,640,839 B2 1/2010 McNulty, Jr.
7,640,860 B1 1/2010 Glover et al.
7,673,411 B1 3/2010 Baldwin
7,686,002 B2 3/2010 Andrews
7,778,005 B2 8/2010 Saliga
7,791,858 B2 9/2010 Hummel et al.
7,856,929 B2 12/2010 Gavin et al.
7,859,818 B2 12/2010 Kroll et al.
7,900,388 B2 3/2011 Brundula et al.
7,905,180 B2 3/2011 Chen
7,950,176 B1 5/2011 Nemtyshkin et al.
7,950,329 B1 5/2011 Nemtyshkin et al.
7,984,676 B1 7/2011 Gavin et al.
8,015,905 B2 9/2011 Park
8,024,889 B2 * 9/2011 Bunker ..... A01M 1/14 102/367
8,082,199 B2 12/2011 Kwok
D651,679 S 1/2012 Klug et al.
8,096,076 B1 1/2012 Cerovic et al.
8,141,493 B1 3/2012 Kuchman
8,186,276 B1 5/2012 Olden et al.
8,231,474 B2 7/2012 Stethem
8,245,617 B2 8/2012 Martinez et al.
8,261,666 B2 9/2012 Garg
8,281,776 B2 10/2012 Körver et al.
8,339,763 B2 12/2012 McNulty, Jr.
8,441,771 B2 * 5/2013 Hinz ..... F41H 13/0025 361/232
8,547,679 B2 10/2013 Gavin
8,561,516 B2 10/2013 Martinez et al.
8,601,928 B2 12/2013 Martinez et al.
8,671,841 B2 3/2014 Raquin et al.
8,695,578 B2 4/2014 Olden et al.
8,677,675 B2 5/2014 Koch
8,757,039 B2 6/2014 Martinez et al.
8,857,305 B1 * 10/2014 Tseng ..... F41B 15/10 124/71
8,881,654 B2 11/2014 Seecamp

(56) References Cited

U.S. PATENT DOCUMENTS 8,896,982 B2 * 11/2014 Beechey ..... F41H 13/0018 102/504
8,899,139 B2 12/2014 Brill et al.
9,025,304 B2 5/2015 Brundula et al.
D736,885 S 8/2015 Swan et al.
9,134,099 B2 9/2015 Tseng
9,157,694 B1 10/2015 Tseng
9,220,246 B1 12/2015 Roman
9,255,765 B2 2/2016 Nelson
9,303,942 B2 4/2016 Sievers
9,335,119 B2 5/2016 Werner
9,414,578 B2 8/2016 Thornbrough
9,435,619 B1 9/2016 Park
9,528,802 B1 * 12/2016 Markowitch ..... F42B 12/58
9,581,417 B2 2/2017 Tseng
9,638,498 B2 5/2017 Chang
D791,901 S 7/2017 Swan et al.
10,107,599 B2 10/2018 Norris et al.
10,288,388 B1 5/2019 Lavin et al.
10,634,461 B2 * 4/2020 Norris ..... F41H 13/0006
2002/0134365 A1 9/2002 Gray
2002/0170418 A1 11/2002 McNulty Jr et al.
2002/0198072 A1 * 12/2002 LaSee ..... F42B 12/68 473/578
2003/0106415 A1 6/2003 Smith
2003/0165041 A1 9/2003 Stethem
2003/0165042 A1 9/2003 Stethem
2004/0245338 A1 12/2004 Poloniewicz
2005/0166441 A1 8/2005 Mattox
2006/0112574 A1 6/2006 Hodge et al.
2006/0120009 A1 6/2006 Chudy, II
2006/0254108 A1 11/2006 Park
2007/0019358 A1 1/2007 Kroll
2007/0070573 A1 3/2007 Nerheim et al.
2007/0070574 A1 3/2007 Nerheim et al.
2007/0079538 A1 4/2007 Smith et al.
2007/0081292 A1 4/2007 Brundula et al.
2007/0081293 A1 4/2007 Brundula et al.
2007/0101893 A1 5/2007 Shalev et al.
2007/0188972 A1 8/2007 Nerheim et al.
2007/0264079 A1 11/2007 Martinez et al.
2008/0204965 A1 8/2008 Brundula et al.
2008/0259520 A1 10/2008 Brundula et al.
2009/0025597 A1 1/2009 Kapeles et al.
2009/0084284 A1 4/2009 Martinez et al.
2009/0323248 A1 12/2009 Brundula et al.
2010/0071678 A1 * 3/2010 Allen ..... G02B 6/52 102/504
2010/0126483 A1 5/2010 Makowski
2010/0315755 A1 12/2010 Gavin
2010/0315756 A1 * 12/2010 Gavin ..... F41H 13/0025 361/232
2011/0005373 A1 * 1/2011 Martinez ..... F42B 30/00 361/230
2011/0146133 A1 * 6/2011 Bunker ..... A01M 1/20 43/132.1
2011/0271825 A1 11/2011 Howland
2012/0019975 A1 1/2012 Hanchett et al.
2012/0170167 A1 7/2012 Beechey et al.
2012/0210904 A1 8/2012 Merems
2012/0257320 A1 10/2012 Brundula et al.
2013/0208392 A1 8/2013 Brundula et al.
2014/0331984 A1 11/2014 Brahler, II et al.
2014/0334058 A1 11/2014 Galvan et al.
2015/0075073 A1 3/2015 Sylvester
2015/0168107 A1 6/2015 Tseng
2015/0241180 A1 8/2015 Pruett
2015/0276351 A1 10/2015 Pekarek et al.
2015/0316345 A1 11/2015 Brahler, II et al.
2016/0010949 A1 1/2016 Teetzel et al.
2016/0161225 A1 6/2016 Searle et al.
2016/0238350 A1 8/2016 Tseng
2017/0029816 A1 2/2017 Swiderski
2017/0160060 A1 * 6/2017 Purvis ..... F41H 13/0006
2017/0241751 A1 8/2017 Nerheim
2017/0276460 A1 9/2017 Norris et al.
2017/0276461 A1 * 9/2017 Norris ..... F42B 5/03
2018/0003462 A1 1/2018 Chavez
2018/0292172 A1 10/2018 Ehrlich
2018/0372456 A1 * 12/2018 Norris ..... F41H 13/0006
2019/0186872 A1 6/2019 Salisbury et al.
2020/0018583 A1 * 1/2020 Norris ..... F41B 15/10
2020/0072584 A1 * 3/2020 Ozanne ..... F42B 6/04
2020/0096297 A1 * 3/2020 Norris ..... F41H 13/0025
2020/0109924 A1 4/2020 Goodchild et al.

FOREIGN PATENT DOCUMENTS

DE 3522661 A1 1/1987
GB 2386673 A 9/2003
JP 2011/106748 A 6/2011
RU 2186492 C2 8/2002
RU 2274823 C1 4/2006
RU 2410625 C2 1/2011

* cited by examiner

ENTANGLING PROJECTILES AND SYSTEMS FOR THEIR USE

PRIORITY CLAIM

This is a continuation of U.S. patent application Ser. No. 16/825,868, filed Mar. 20, 2020, which is a divisional of U.S. patent application Ser. No. 16/015,932, filed Jun. 22, 2018, now issued as U.S. Pat. No. 10,634,461, which claimed priority of and to U.S. Provisional Patent Application Ser. No. 62/524,499, filed Jun. 24, 2017, each of which is hereby incorporated herein by reference in its entirety.

RELATED CASES

This application is related to U.S. patent application Ser. No. 15/081,440, filed Mar. 25, 2016, and U.S. patent application Ser. No. 15/399,537, filed Jan. 5, 2017, and U.S. patent application Ser. No. 15/467,958, filed Mar. 23, 2017, each of which is hereby incorporated herein by reference in its entirety.

BACKGROUND OF THE INVENTION

Field of the Invention

The present invention relates generally to non-lethal, ranged weapons systems to aid in impeding or subduing hostile or fleeing persons of interest.

Related Art

It has been recognized for some time that police and military personnel can benefit from the use of weapons and devices other than firearms to deal with some hostile situations. While firearms are necessary tools in law enforcement, they provide a level of force that is sometimes unwarranted. In many cases, law enforcement personnel may wish to deal with a situation without resorting to use of a firearm. It is generally accepted, however, that engaging in hand-to-hand combat is not a desirable choice.

For at least these reasons, ranged engagement devices such as the Taser™ have been developed to provide an alternative. While such electrical muscular disruption ("EMD") weapons have been used with some success, debates continue as to whether such devices are as safe as claimed or are an appropriate level of force for many situations. Other ranged engagement solutions, such as mace or pepper spray, are very limited in range and are often criticized for the pain caused to subjects and the potential for such solutions to affect police or bystanders.

As such, designers continue to seek non-lethal solutions that can be effectively used by police or law enforcement especially to impede or subdue fleeing subjects.

SUMMARY OF THE INVENTION

In accordance with one aspect of the invention, an entangling projectile for use with a projectile deployment system is provided. The entangling projectile can include a pair of pellets. At least one of the pair of pellets can have a head with a head outer diameter and a shank with a shank outer diameter. The shank outer diameter can be less than the head outer diameter. A tether can connect the pair of pellets. A centering shroud can be carried by a shank of the at least one of the pair of pellets, the centering shroud having at least one tether opening formed therein to receive the tether. The tether can be coupled to the pellet and can extend along the shank of the pellet and through the at least one tether opening formed in the centering shroud.

In accordance with another aspect of the technology, a method is provided of loading an entangling projectile within a projectile launcher. The method can include obtaining an entangling projectile. The entangling projectile can include a pair of pellets, with each of the pair of pellets having a head with a head outer diameter and a shank with a shank outer diameter. The shank outer diameter can be less than the head outer diameter. A shroud can be coupled to a shank of each of the pair of pellets, the shroud having a tether opening formed therein to receive the tether. A tether can connect the pair of pellets. The method can include positioning each of the pair of pellets within one of a pair of sockets associated with the projectile launcher such that the head of each pellet is positioned upstream of the shank and the shroud is positioned downstream of the head with the tether fitted within the tether opening of the shroud and extending out of the socket.

In accordance with another aspect of the technology, an entangling projectile for use with a projectile deployment system is provided. The entangling projectile can include a pair of pellets. At least one of the pair of pellets can have a head with a head outer diameter and a shank with a shank outer diameter. The shank outer diameter can be less than the head outer diameter. A tether can connect the pair of pellets. A stabilizer can be carried by a shank of the at least one of the pair of pellets in a location displaced from the head of the pellet, with an open space defined adjacent the shank between the stabilizer and the head of the pellet.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
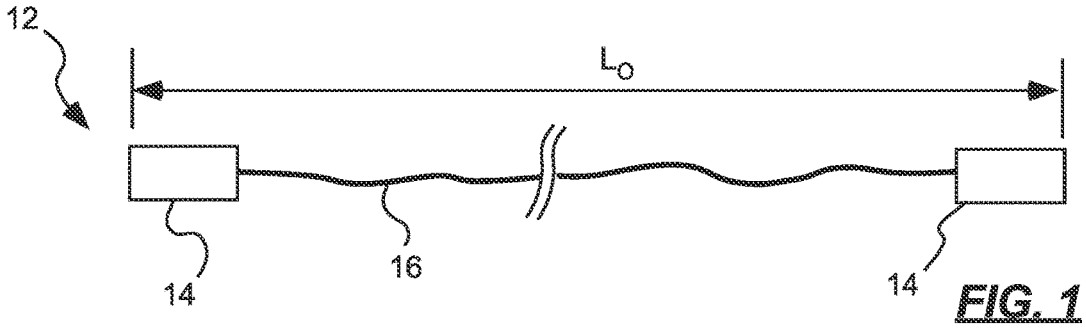
FIG. 1 is a top, bottom, front or rear view of an entangling projectile extended substantially to its full length in accordance with an embodiment of the invention.
Figure 2A:
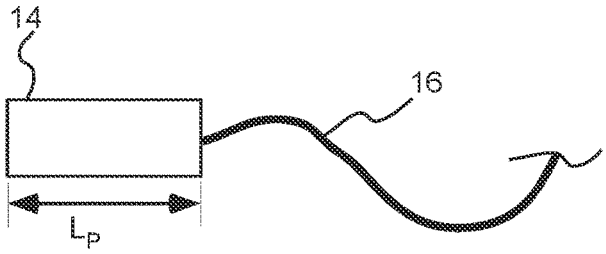
FIG. 2A is a side view of a pellet and a portion of a tether of the projectile of FIG. 1.
Figure 2B:
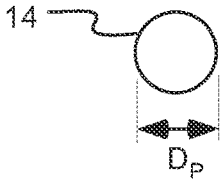
FIG. 2B is an end view of the pellet of FIG. 2A.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a pellet" can include one or more of such pellets, if the context dictates.

As used herein, the terms "firearm blank" or "blank cartridge" refer to the well-known blank cartridge that can be used with firearms. Such blank cartridges contain gunpowder but not a bullet or shot: as such, they can be discharged to produce only a high velocity pressure wave, without an accompanying shot or slug.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, the terms "upstream," downstream" and the like are to be understood to refer to directions relative to the flow of fluid within the projectile launchers disclosed herein. Such terms are not necessarily limited to the geometric configuration of the launchers, but rather to the flow of fluid through components of the launchers. As an arbitrary example, one component of a projectile launcher may be physically above a second component, but the upper component may be downstream relative to the second component if the second component experiences fluid flow first.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to non-lethal weapons systems, sometimes referred to as ensnarement or entanglement systems, that can be effectively used as an aid in impeding the progress of or detaining aggressive or fleeing subjects. Devices in accordance with the present technology can be advantageously used to temporarily impede a subject's ability to walk, run, or use his or her arms in cases where law enforcement, security personnel or military personnel wish to detain a subject, but do not wish to use lethal or harmful force or to engage in close proximity hand-to-hand combat. The technology provides a manner by which the arms or legs of a subject can be temporarily tethered or bound, to the extent that the subject finds it difficult to continue moving in a normal fashion.

While the present technology can be directed at any portion of a subject's body, the following discussion will focus primarily on use of the technology to temporarily tether or bind a subject's legs. It is to be understood, however, that the present technology is not limited to this application. In some cases, multiple portions of the subject's body can be targeted, such as both the arms and the legs.

As shown generally in FIGS. 1-5, the present technology provides an entangling projectile 12 that can be deployed toward a subject's legs to cause the projectile to wrap about the subject's legs. The projectile includes at least one flexible tether 16 and at least two pellets 14, coupled together by the tether. By engaging a subject with the entangling projectile, the subject is temporarily rendered partially or fully incapacitated and thereby restricted in his or her ability to flee or attack. The entangling projectiles of the present technology are launched toward a subject (100 in FIGS. 3A-4) by a launcher. In addition to the launchers discussed herein, numerous examples of suitable launchers are provided, as examples, in the above-referenced parent case, U.S. patent application Ser. No. 15/081,440, filed Mar. 25, 2016, which is hereby incorporated herein by reference in its entirety. Such launchers can include energy sources such as compressed gas, explosives/combustibles, mechanical springs, etc.

Generally speaking, a launcher for use with the present entangling projectiles will launch the projectile toward a subject 100 at a relatively high rate of speed. Typically, the projectile can be deployed toward a subject from a distance of between about 6 feet and about 30 feet (1.8 to 9.1 meters), and engages the subject within a matter of about 0.0075 to 0.0375 seconds (traveling at about 800 ft/sec (243.8 m/s)). After being deployed from the launcher, the entangling projectile will wrap about the subject's legs two or three or more times, causing the subject to be temporarily unable to effectively move. As the entangling projectile can be launched from some distance, law enforcement personnel can maintain a safe distance from a subject, yet still be able to effectively and safely temporarily restrain, disable or impede the subject.

Figure 4:
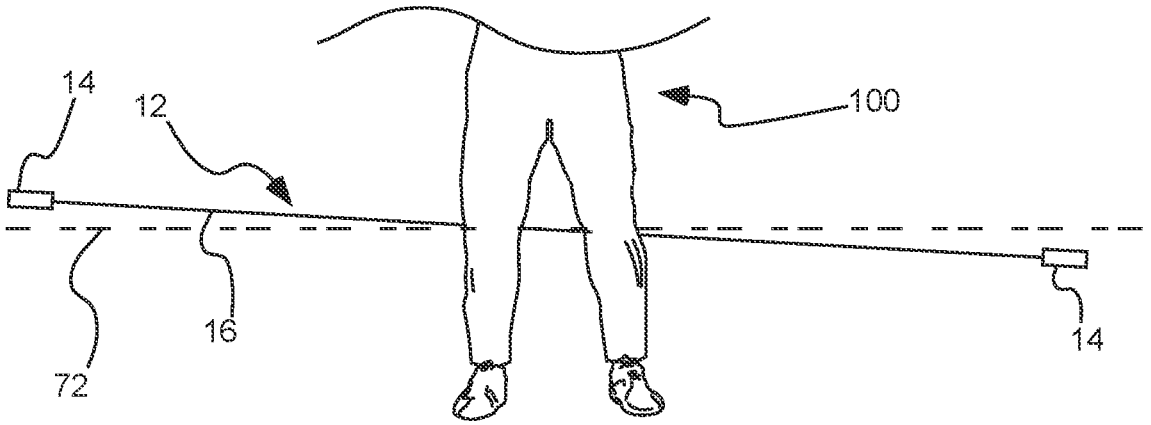
FIG. 4 is a front view of a portion of a subject in accordance with an embodiment of the invention, shown immediately prior to an entangling projectile engaging the subject's legs.

Operation of the entangling projectile is shown generally in FIG. 4: after being released by a launcher, the projectile 12 travels toward a subject 100. As the projectile travels toward the subject, pellets 14 travel away from one another, resulting in the tether 16 being pulled substantially taught between the two. Once the projectile engages the subject (in the example shown in FIG. 4 the subject's legs are engaged), the pellets and tether wrap about the subject and thereby temporarily entangle and/or disable the subject.

A variety of differing pellet and tether combinations can be utilized in the present technology. In the examples shown in FIGS. 1-4, the projectile 12 is shown with two generic pellets 14 connected by a single tether 16. While more than two pellets can be utilized, the examples shown herein include only two. In some embodiments, the invention is limited to two, and only two, pellets connected by a single tether. In one aspect, the invention consists of two pellets and a single tether. In one aspect, the invention consists essentially of two pellets and a single tether. It has been found that limiting the number of pellets to two results in a more effective deployment system: the risk of tangling of the tether 16 is diminished and the pellets spread apart from one another much more cleanly and quickly after being deployed from the launcher. This results in a more consistent trajectory after deployment. This arrangement can also allow, with the proper launcher configuration, the projectiles to be more accurately directed toward a subject.

Figure 5:
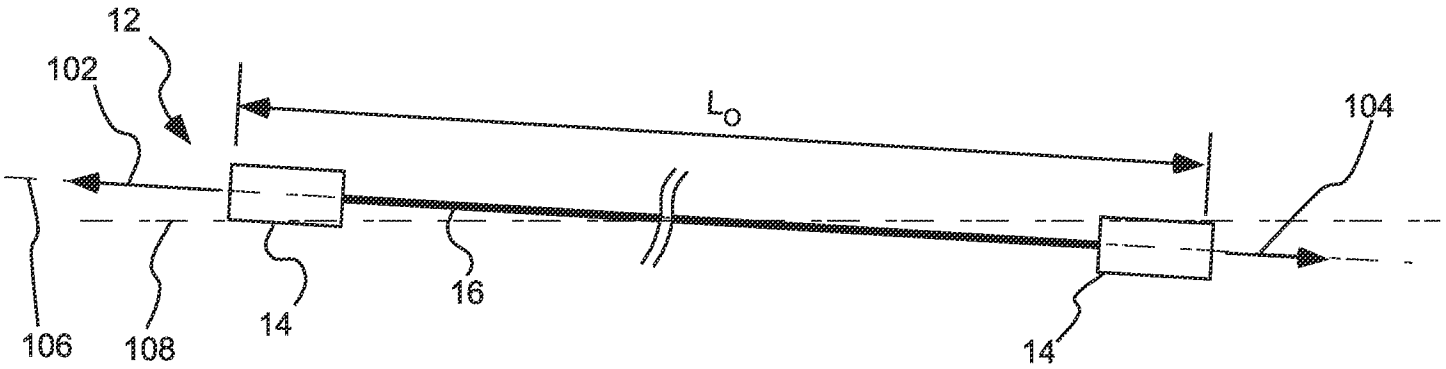
FIG. 5 is a front view of an entangling projectile in accordance with another embodiment of the invention, shown with the pellets pulling the tether into a taught condition.

FIG. 5 illustrates further features of the entangling projectile 12. As referenced above, the projectile includes two pellets 14 coupled on opposing ends of a tether 16. In this embodiment, two and only two pellets are provided, coupled by only a single tether 16. The use of only two pellets has been found to be advantageous in that a much cleaner and accurate projectile can be directed toward a subject, and the projectile can more effectively engage the subject. The pellets 14 can apply equal and opposite forces, shown by example with directional indicators 102 and 104, upon tether 16. In this manner, the tether is pulled into a taught, linear configuration by the force of the pellets traveling away from one another.

The tether 16 can include no additional structure coupled thereto, with no additional structure extending therefrom. In this manner, the pellets 14 can pull the tether into the straight, uninterrupted, linear configuration shown. The tether and pellets can occupy substantially a common plane 106 in the configuration immediately prior to contacting a subject. As shown, this plane 106 is typically angularly offset from "true" horizontal 108, as the pellets are positioned at differing elevations prior to contact with the subject (as detailed further below). By omitting additional pellets or tethers, or other extraneous structure, the present technology can deliver an entangling projectile that engages subjects with a much higher rate of successful engagement.

FIG. 1 illustrates the projectile 12 extended to its full length "$L_O$." In one embodiment, the overall length of the tether is much longer than the size of pellets ($L_P$). The overall length can be on the order of seven feet (2.14 meters) or greater. The pellets can have a length "$L_P$" on the order of an inch (2.54 cm), and a diameter "$D_P$" on the order of ⅜ of an inch (0.95 cm). While differing embodiments of the technology can vary, it is generally desirable to maintain the pellets at a relatively small size to thereby limit the overall size requirements of the projectile casing that houses the pellets prior to deployment and to reduce the impact should a pellet hit the subject. In this manner, the technology can be provided in a lightweight, hand-held device.

The relationship of the pellet diameter, weight and length in relation to the tether length/weight can significantly affect the performance of the entangling projectile. It has been found that a pellet diameter of about 0.330 inches (0.84 cm) with a length of about 1 to 1.5 inches (2.54-3.81 cm) with a weight of about 5-6 grams combined with a tether of about 7 feet (2.13 m) weighing about 1 gram provides an effective entangling projectile. The present projectile casing discussed below has been designed to effectively deliver such entangling projectiles with a high degree of precision and reliability.

The tether 16 can be formed from a variety of materials. In one aspect, the tether is formed from conventional nylon material. Waxed cord can also be used, as the wax can aid in packing and/or coiling the tether to properly fit within, and stay within, the tether compartments. In one embodiment, the tether can be formed from an elastic material.

In one example, the tether is formed from Kevlar™ cord, with a thickness of about 0.1 mm. A Kevlar tether has been found to perform well for a number of reasons. The Kevlar tether is very strong, and not as prone to breakage as other cords. In addition, the Kevlar material does not tend to "wick" adhesives as do other materials—thus minimizing drying/curing times of adhesive and reducing the tendency of the cord to become stiff with cured adhesive that have wicked long stretch of cord.

Figure 6:
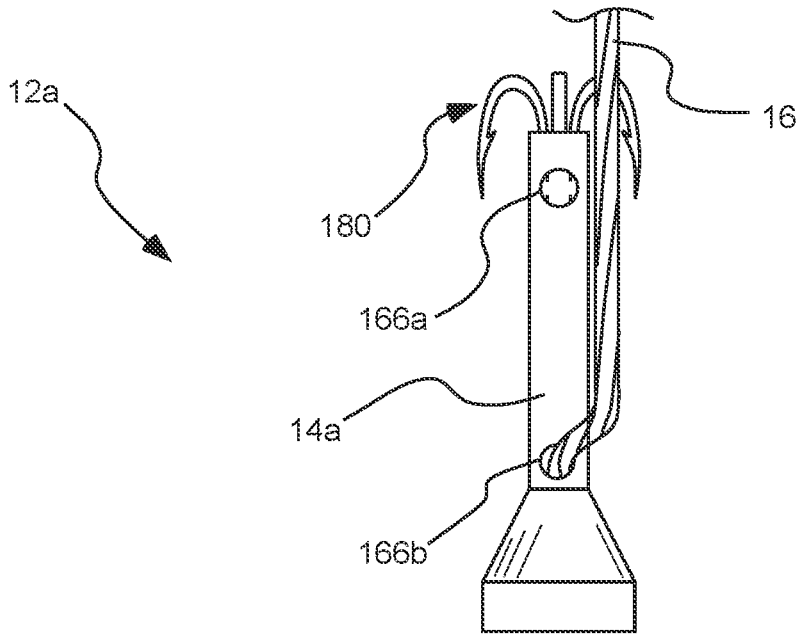
FIG. 6 is a side view of a portion of an entangling projectile in accordance with another embodiment of the invention.

FIG. 6 illustrates a portion of one exemplary entangling projectile 12*a* in accordance with an embodiment of the invention. In this example, pellet 14*a* is provided that includes various features that aid in more accurately and effectively engaging a subject. A portion of tether 16 is shown extending from access hole 166*b*, which is generally formed in or through a shank of the pellet 14*a*. The tether can be secured to the shank by the use of adhesive applied through access hole 166*b*. A hook assembly 180 can be attached atop the shank of the pellet, and can be secured to the shank via application of adhesive through access hole 166*a*. Access holes 166*a* and 166*b*, which function much like rosettes, can be used to allow the hook structure or pellet to be coupled to the tether, or to one another. In the embodiment of FIG. 6, the hook assembly 180 can be positioned where desired, and a small amount of adhesive or other attachment material can be applied through access hole 166*a* to mount the hook assembly in position. Access hole 166*b* can be easily used in the same manner to mount the pellet 14*a* to the tether 16.

The entangling projectile 12*a* shown in FIG. 6 is but one example of the various types of projectiles that can be used with the present invention. Further examples are provided in the above-referenced parent case, U.S. patent application Ser. No. 15/399,537, filed Jan. 5, 2017, which is hereby incorporated herein by reference.

While the present projectiles can be used with variety of launchers, FIGS. 7 through 13 illustrate one exemplary system that can be utilized to effectively direct the entangling projectile toward a subject. As shown in exploded view in FIG. 7, the projectile deployment system 40 generally includes an entangling projectile that includes a pair of pellets 14*a*, 14*b*, and a tether 16 connecting the pellets (note that the tether is omitted from many of these views to enable a clearer description of other components). A projectile casing 44 is provided that can include a pair of sockets 30*a*, 30*b* (see FIGS. 8, 10 and 11, for example). Each socket can be sized and shaped to carry one of the pair of pellets: in the examples shown, socket 30*a* carries pellet 14*a* and socket 30*b* carries pellet 14*b*.

The projectile casing 44 can include a selectively activatable pressure source 50 (FIGS. 9-12). The pressure source can be carried by the projectile casing, independently of the launcher or other components of the system. The pressure source can be capable of expelling the entangling projectile from the projectile casing toward a subject 100. The system can also include a launcher 42 that can carry an activator operable to activate the pressure source to expel the entangling projectile from the projectile casing toward the subject. One example of activator 54 is discussed in more detail below in relation to FIG. 13.

The projectile casing 44 can be removably engageable with the launcher 42 to allow removal of the projectile casing from the launcher after expulsion of the entangling projectile 12 from the projectile casing. In this manner, the present technology provides a deployment system that includes two separate and distinct components: the launcher 42 and the projectile casing 44. In one embodiment, the pellets 14*a*, 14*b* and tether 16 are carried by the projectile casing, as is the pressure source 50. The activator (54 in FIG. 13, for example) is carried by the launcher. Generally, all components necessary to power the activator are carried by the launcher, and all components necessary to launch the projectile are carried by the projectile casing. In this manner, the unit as a whole is not operable until the casing 44 and the launcher 42 are functionally engaged with one another. Once the two are engaged with one another, operation of the launcher 42 (and the activator 54) results in expulsion of the entangling projectile from the casing 44.

In the example shown, launcher 42 includes a trigger panel 46, discussed in more detail below in connection with FIG. 13. Generally, activation of the trigger panel causes the launcher 42 to activate the pressure source 50, which results in expulsion of the entangling projectile from the casing 44. Once the projectile has been deployed from a particular projectile casing, that casing can be removed and a fresh projectile casing with a preinstalled entangling projectile 12 and pressure source can be installed within the launcher. Activation of a first casing and replacement with a fresh casing can be achieved in a matter of seconds. Thus, law enforcement, security, military, etc., personnel can very rapidly exchange a spent projectile casing with a fresh projectile casing that is loaded and ready to activate by the launcher.

As the casing 44 can include all the disposable components of the system, the launcher 42 can have an extended useful life and rarely, if ever, need be replaced or maintained. The entangling projectile 12 and pressure source 50 can be installed within the projectile casing in a controlled environment, thereby ensuring that a clean, effective deployment can be consistently achieved. Projectile casings can be provided to law enforcement personnel loaded and ready to use, requiring only that the personnel insert the projectile casing into the launcher. While it is contemplated that end users of the device could reload the projectile casing with a pressure source and entangling projectile, they are not required to do so and is felt likely that quality can be much better controlled by preloading the projectile casing with both the entangling projectile and the pressure source.

The casing 44 can be held within the launcher 42 in a variety of manners. In one embodiment, the casing can "snap" into the launcher and be firmly held in position by one or more mechanical locks (not shown in detail). The locks can be easily disengaged by an end user when it is desired to remove the casing from the launcher.

Figure 7:
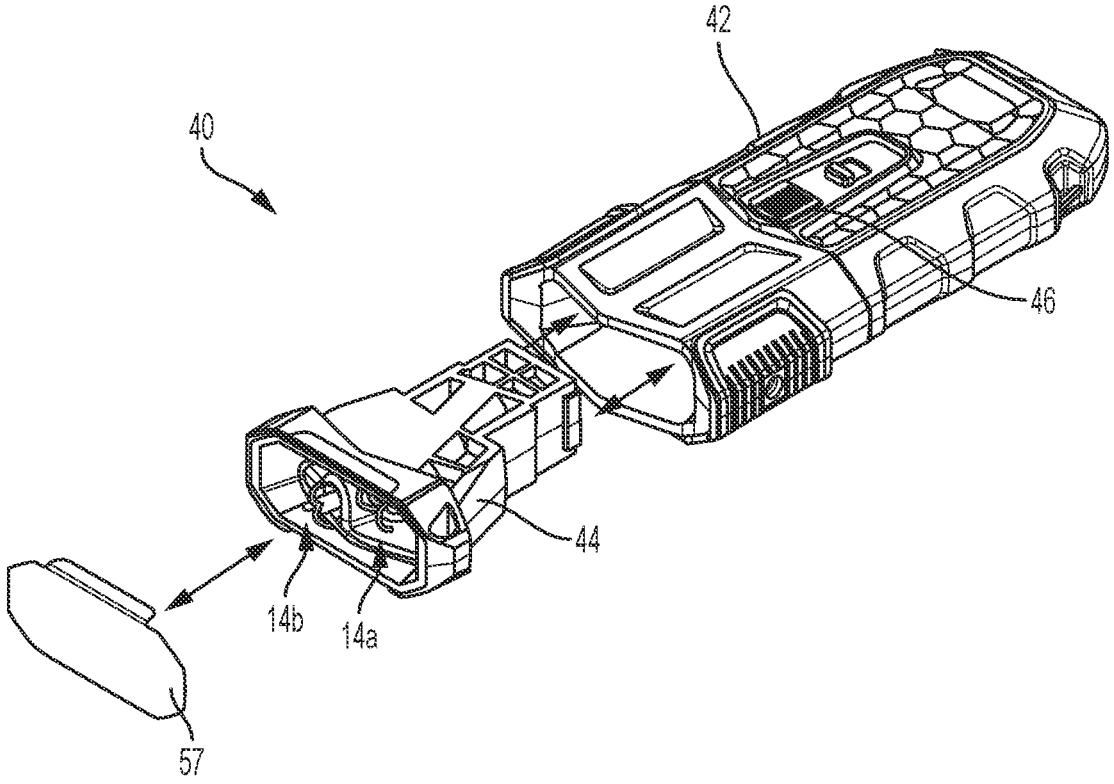
FIG. 7 is a top perspective view of a projectile deployment system of the present invention, shown in an exploded condition with a projectile casing being removed from or installed in a launcher.
Figure 8:
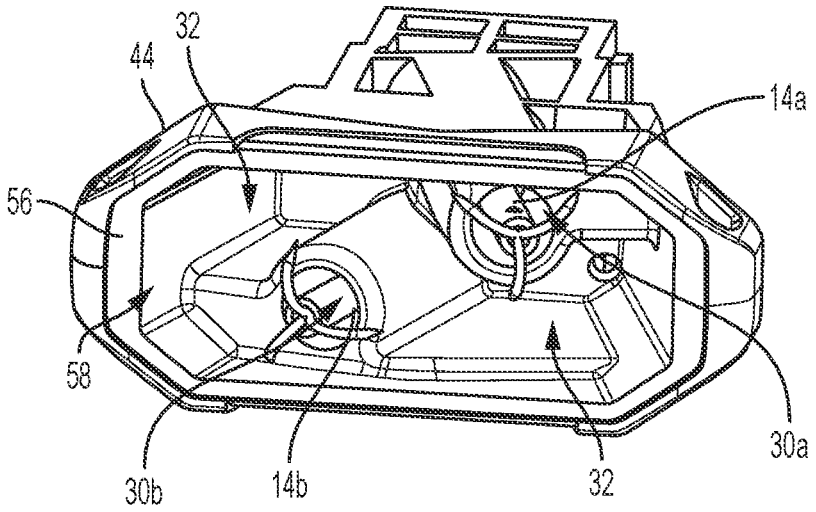
FIG. 8 is a front view of the projectile casing of FIG. 7.
Figure 9:
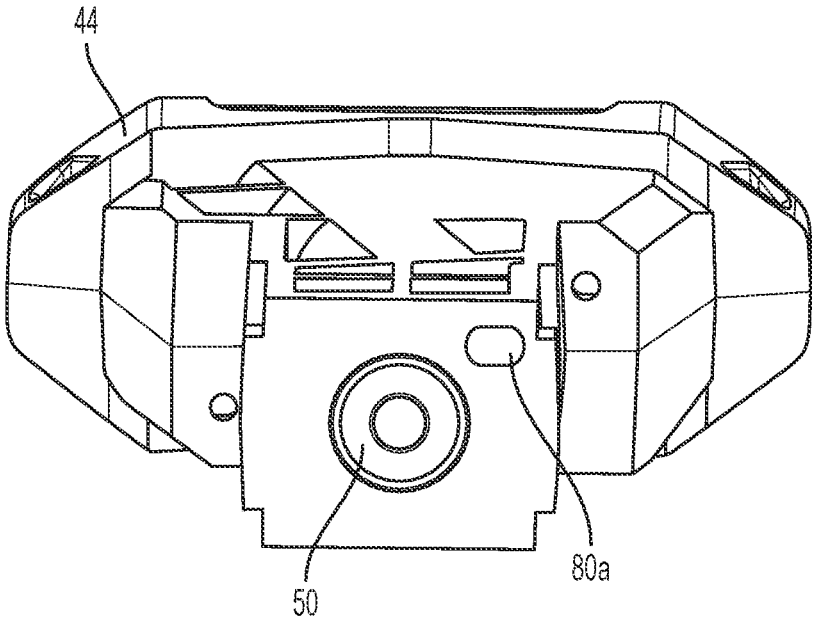
FIG. 9 is a rear view of the projectile casing of FIG. 7.

FIG. 8 illustrates a front view of the casing 44. In this view, pellets 14*a*, 14*b* can be seen stored, ready for use, in sockets 30*a*, 30*b*, respectively. Tether storage compartments 32 can be provided and can consist of shaped depressions formed in the projectile casing to allow the tether (not shown in this view) to be stored adjacent the pellets prior to use. The projectile casing can include a front shoulder 56 that can serve to create a protective pocket 58 around the tether and the pellets. As shown in FIG. 7, a cover 57 can be applied over the pocket 58 and can be attached to the shoulder 56 to protect the pocket from exposure to contaminants and/or to contain the entangling projectile within the projectile casing.

In the examples shown in FIGS. 9-12, the pressure source 50 comprises a cartridge blank. This type of pressure source is well known to contain gunpowder that is typically activated by striking a primer formed in the cartridge. The blank cartridge contains no slug; deployment of the cartridge results only in a high-pressure wave being directed from the projectile casing. This high-pressure wave is utilized by the present technology to propel the entangling projectile from the system at high velocity. In one embodiment of the invention, the cartridge blank can be irremovably attached to the cartridge such that the cartridge is a single actuation cartridge. In this manner, installation of the cartridge can be done in a controlled manufacturing environment, to ensure the proper cartridge is use, that the cartridge is properly installed, and that the casing 44 is otherwise ready for use. The cartridge can be secured to the casing by adhesive, mechanical crimp, etc.

By irremovably attaching the cartridge blank 50 to the casing 44, there is little to no risk that an actual bullet or "real" cartridge can be accidentally inserted into the casing. In addition, a length and configuration of the central bore 60 can be configured to prevent the insertion of anything other than a properly designed blank cartridge 50.

Figure 10:
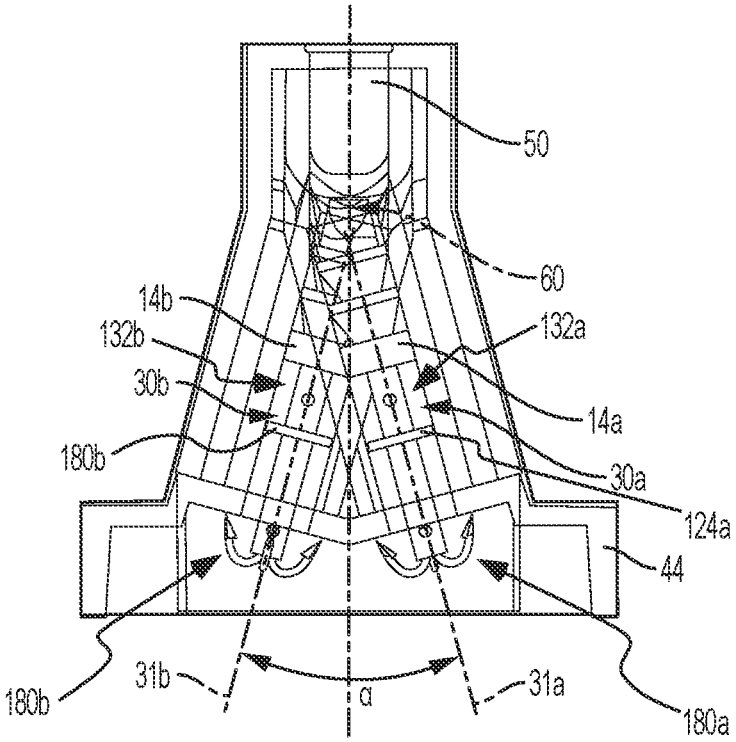
FIG. 10 is a top, partially sectioned view of the projectile casing of FIG. 7.
Figure 11:
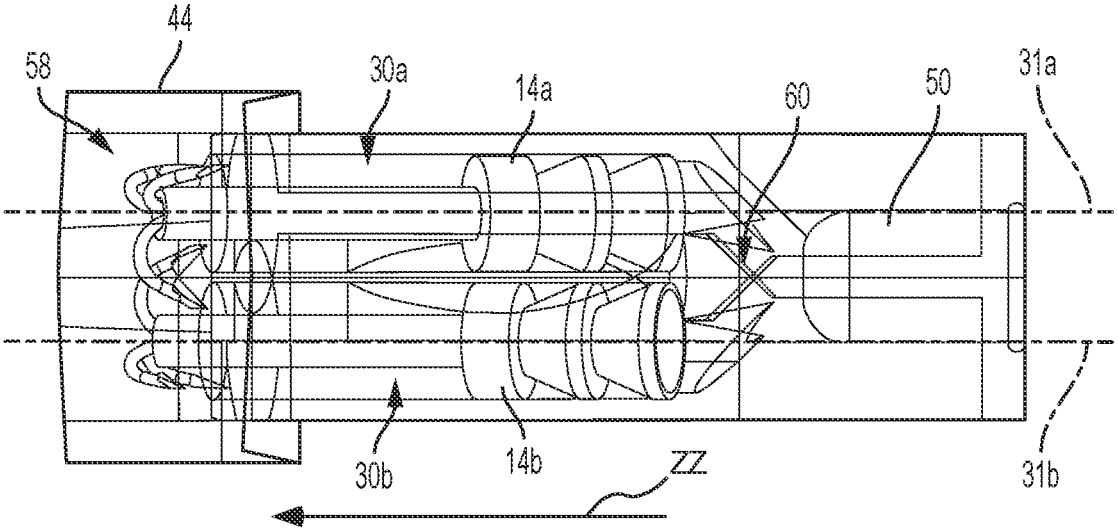
FIG. 11 is a side, partially sectioned view of the projectile casing of FIG. 7.
Figure 12:
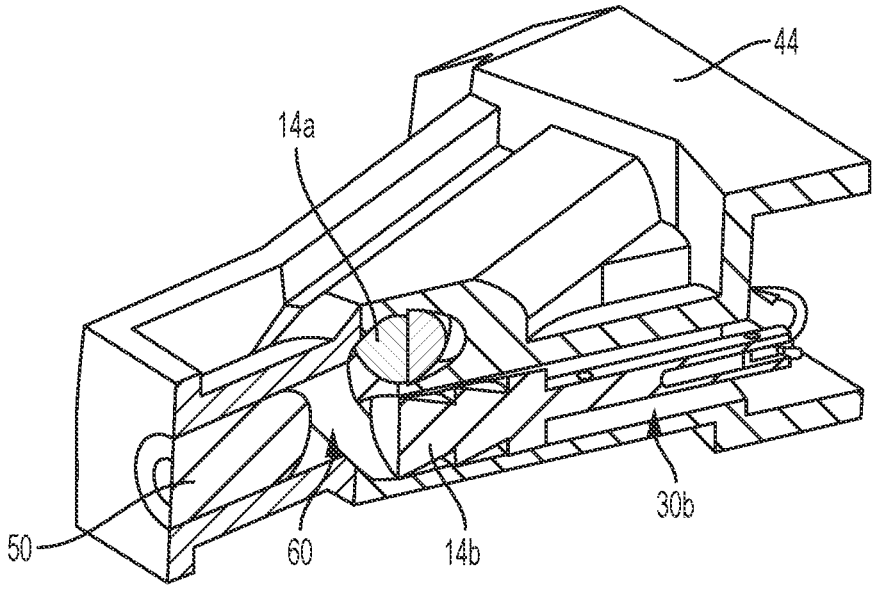
FIG. 12 is another side, partially sectioned view of the projectile casing of FIG. 7.

In contrast, the entangling projectile 12 is removably installed within the projectile casing. All components of the entangling projectile (i.e., the pellets 14*a*, 14*b* and tether 16) are installed within the casing such that they can be readily and completely ejected from the casing when the pressure source 50 is deployed. The geometry of the sockets 30*a*, 30*b* within the casing 44, along with the geometry of the pellets, has been carefully designed to ensure that a consistent, effective deployment of the entangling projectile is achieved each time the launcher is activated. FIGS. 10-12 illustrate this geometry in more detail.

A shown in top view in FIG. 10, the sockets 30*a* and 30*b* are angled relative to one another such that the pellets 14*a*, 14*b* travel apart from one another as they are expelled from the projectile casing 44. In the example shown, at least a portion of one of the sockets extends beneath a portion of another of the sockets within the cartridge (in this example, "bottom" socket 30*b* extends beneath "upper" socket 30*a*). Depending upon the particular arrangement, one of the pellets can overlap, or extend beneath or above, another of the pellets when the pellets are installed within the sockets. In the example shown, pellet 30*b* extends beneath (when viewed perpendicularly from a horizontal plane on which the casing sits) pellet 30*a* when the pellets are stored and ready for activation. As shown in side view in FIG. 11, in one example, the sockets can also be, or can alternatively be, vertically offset relative to one another and can extend in planes parallel to one another. In the example shown, the sockets are both oriented horizontally but are "stacked," or offset vertically, so that the pellets exit the sockets having an orientation parallel to the horizon but with differing vertical elevations.

The casing 44 can also include a central bore 60, shown in FIGS. 10-12, located immediately adjacent the discharge end of pressure source or blank cartridge 50. In this embodiment, upon activation, the blank cartridge 50 discharges into the central bore a high-pressure wave. This high-pressure wave then travels into both sockets 30*a* and 30*b*, generally distributed equally among the two. Thus, each of socket 30*a* and socket 30*b* terminate into, or are at least in fluid communication with, central bore 60.

As discussed, each of socket 30*a*, 30*b* can hold one pellet, 14*a*, 14*b*, respectively, prior to deployment of the pellets from the projectile casing. As a high-pressure wave is generated by the cartridge, it is directed through the central bore and is applied to the pellets held in sockets 30*a*, 30*b*. The pellets are then forcibly expelled from the inner block toward the subject.

As best appreciated from FIG. 10, the sockets 30*a*, 30*b* can be oriented at an angle "a" relative to one another. While the angle can vary, it is generally an acute angle, typically ranging from about 10 degrees to about 60 degrees. In another embodiment, the angle can range between about 25 degrees to about 45 degrees. In another embodiment, the angle is about 30 degrees. By angling the sockets relative to one another, the pellets 14*a*, 14*b* are directed away from one another as they are expelled from the sockets. In this manner, the pellets separate relative to one another very quickly, pulling the tether 16 taut between them so that the tether can fully extend prior to engaging the subject. The forward energy applied to the pellets is both split between the two pellets and angled by the nature of the sockets: as such, in the event that a pellet inadvertently directly contacts a subject, the force is less than that otherwise applied by a full charge, minimizing the risk of injury to the subject.

Figure 3A:
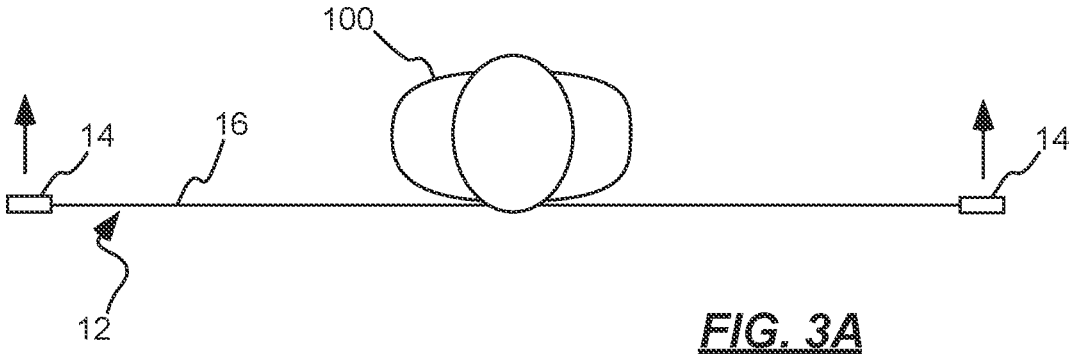
FIG. 3A is a top view of a subject toward which an entangling projectile was launched, shown immediately prior to the entangling projectile engaging the subject.
Figure 3B:
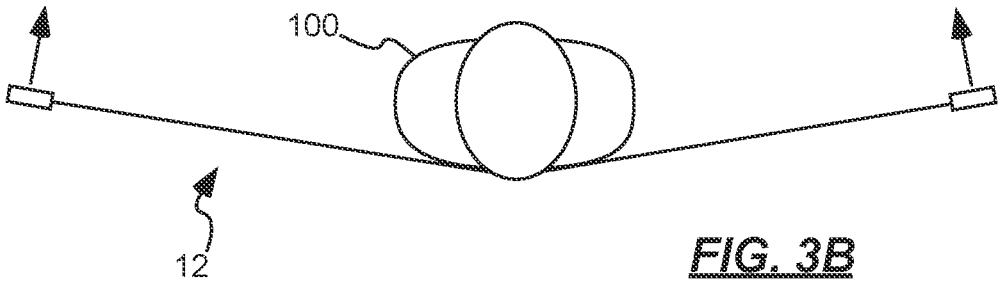
FIG. 3B is a top view of the subject and projectile of FIG. 3A, shown shortly after the entangling projectile engaged the subject.

The resulting launch is shown in FIGS. 3A and 3B. In FIG. 3A, the entangling projectile 12 has been launched toward a subject 100 (shown from above) and has traveled to engage the subject. Prior to contacting the subject, the tether 16 has been pulled taut, such that the pellets 14 are travelling in a linear direction toward the subject. Immediately after the tether 16 contacts the subject, the momentum of the pellets, prevented by the tether from continuing along their present trajectory, causes them to begin moving toward one another (shown in FIG. 3B), which momentum will cause the pellets to orbit about the subject.

As the pellets orbit about the subject's legs, the tether wraps itself tightly about the subject's legs. Note that, as the tether wraps about the subject's legs, the rotational velocity of the pellets will increase, causing them to wrap more quickly as the effective length of the tether is decreased. In an average deployment, the pellets will wrap themselves about the subject's legs 2-3 times, resulting in the tether being wrapped about the subject's legs 4-6 times. As will be appreciated, a subject will at least temporarily have great difficulty moving after the tether is thus wrapped about his or her legs.

Referring again to FIG. 10, in this example the axes 31*a*, 31*b* of the sockets 30*a*, 30*b*, respectively, can intersect one another at a location within the casing 44. That is, a portion or section of one of the sockets can intersect with a portion or section of the other socket within the confines of the casing. In the example shown, sockets 30*a* and 30*b* intersect or overlap where each socket is fluidly coupled to central bore 60. The sockets can also be stacked horizontally relative to one another, to provide an overlapping configuration of one atop the other. In this manner, the sockets can be spaced relatively close to one another while also maintaining a desired angle between the two. The location at which the sockets intersect can be adjusted nearer to or further from the central bore.

This stacking/overlap configuration allows the use of a relatively narrow projectile casing 44 regardless of the angle at which it is desired to orient the sockets. If the sockets were merely oriented in a side-by-side relationship, without overlapping axes, the width or diameter of the projectile casing would have to be increased as the angle "a" between the socket axes 31 was increased. By overlapping the axes, however, this limitation in arranging the sockets is eliminated. This can allow the projectile casing to be much narrower than otherwise possible. This results in a launcher system that can be easily carried by law enforcement personnel, similar to conventional firearms or Taser. While not so limited, in one aspect of the invention, the projectile casing 44 can be formed having a diameter or maximum width of less than about two inches (5.1 cm), and as little as 1½ inches (3.8 cm) or less. The projectile casing can be formed with a length of less than about 2½ inches (6.4 cm), or as little as two inches (5.1 cm) or less. Overlapping or stacking of the sockets also allows a vertical displacement of the pellets to differ as the pellets contact the subject. This vertical offset of the pellets is discussed in more detail in the parent applications referenced above.

Figure 13:
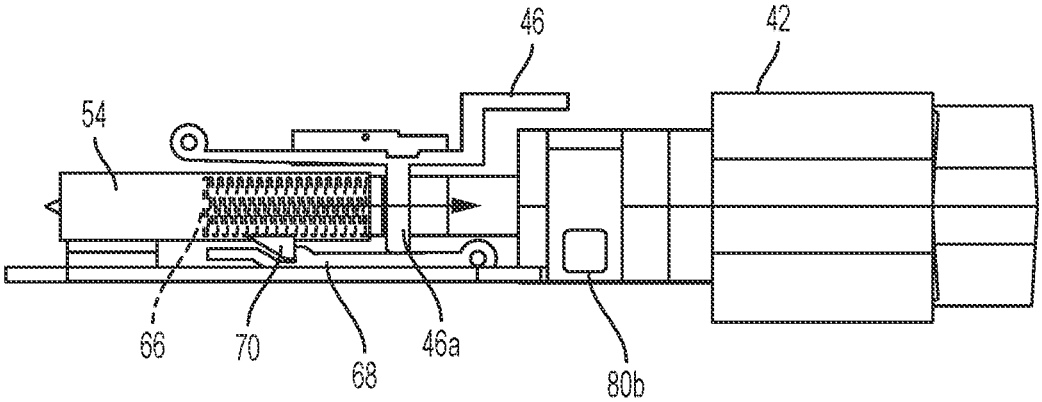
FIG. 13 is a side, partially sectioned view of the launcher of FIG. 7, shown with various components removed to reveal inner components of the launcher.
Figure 14:
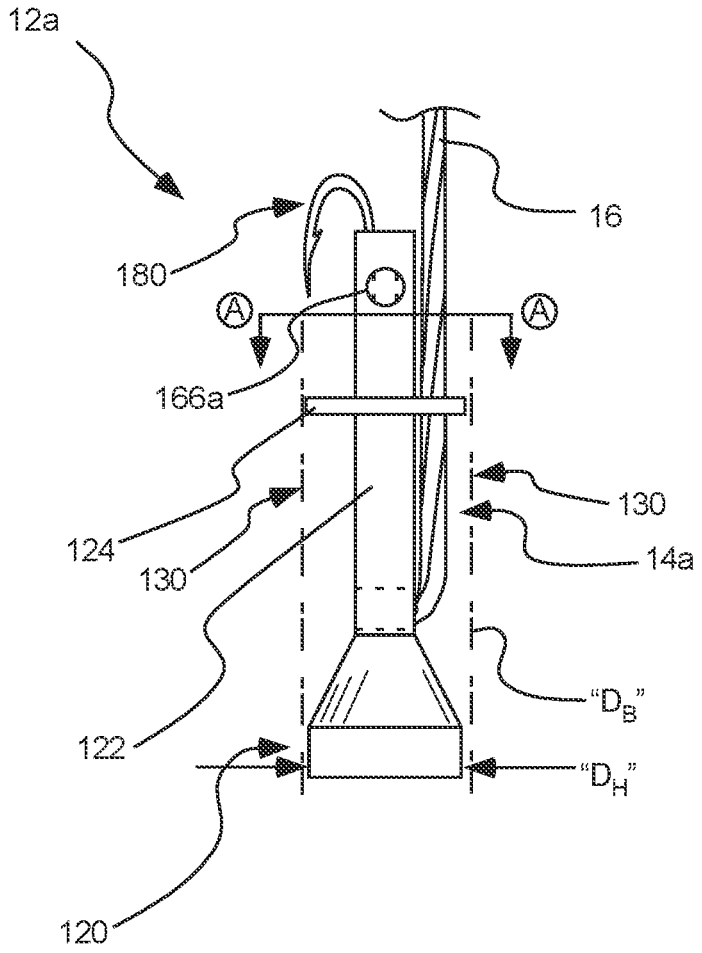
FIG. 14 is a side view of a portion of an entangling projectile in accordance with another embodiment of the invention, shown with a shroud fitted about a portion of the pellet.
Figure 15:
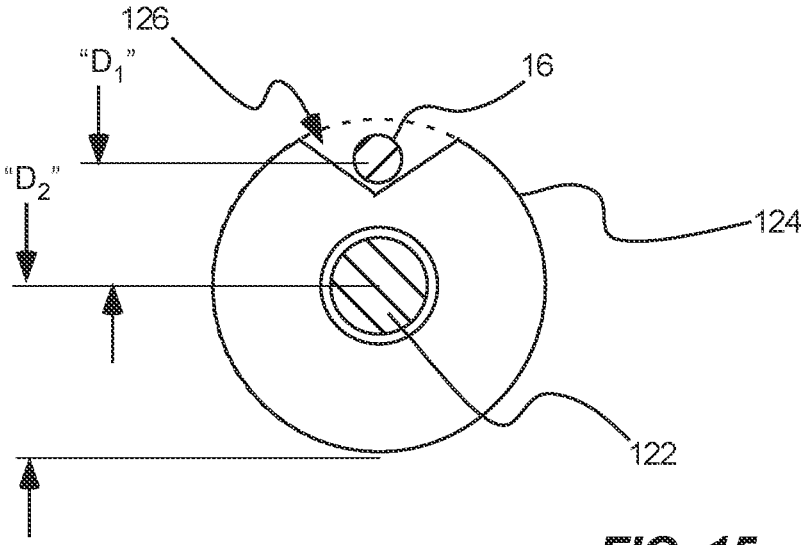
FIG. 15 is a top view of the shroud of FIG. 14, taken along section A-A of FIG. 14.
Figure 16:
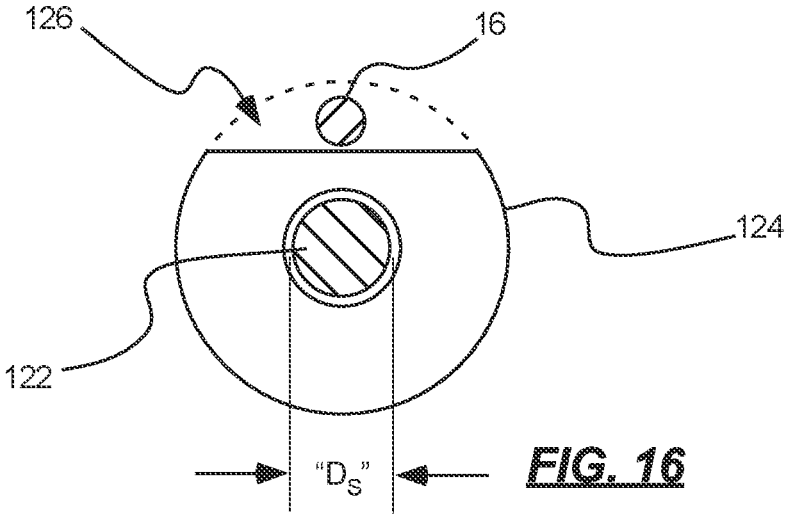
FIG. 16 is a top view of another embodiment of the shroud of FIG. 15.
Figure 17:
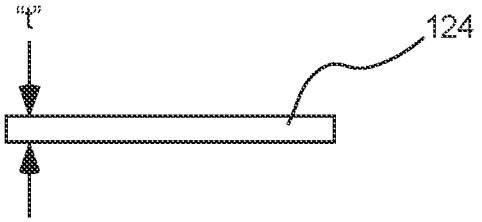
FIG. 17 is an edge view of the shroud of FIG. 15 or FIG. 16.

FIG. 13 illustrates one example of the launcher 42, and some of the components within the launcher. Note that several operable components of the launcher have been omitted from this view in the interest of more clearly illustrating operable principals of the launcher. In this example, the activator comprises a sliding firing bolt 54. The firing bolt can include an internal spring 66 that can be biased into a compressed condition to ready the bolt for firing. This can be accomplished by a sliding "cocking" mechanism (not shown in detail) that can be used to compress the internal spring. Trigger panel 46 (which is generally accessible from atop the launcher) can be depressed when it is desired to activate the launch of the entangling projectile. Depressing panel 46 causes lever 46*a* to depress lever 68, which in turn causes tang 70 to release the firing bolt. The tension in spring 66 then propels bolt 54 along a predetermined trajectory. The blank cartridge 50, when the casing was installed within the launcher, is positioned at the end of the bolt's trajectory. The bolt impacts the cartridge, causing the primer to ignite and generate a high-pressure wave.

While FIG. 13 illustrates general operation of the triggering bolt 54, it is to be understood that many components contributing to operation of the launcher have been omitted from this view. These include, without limitation, structure used to "cock" the firing bolt 54 into ready position; safety mechanisms that can prevent inadvertent activation of the launcher, latching mechanisms that latch the casing 44 to or within the launcher 42, etc. One of ordinary skill in the art, having possession of this disclosure, could readily appreciate the operation of such components.

In addition to utilizing a blank cartridge as the pressure source 50, the pressure source can be provided in a number of other forms. In one example, the pressure source includes a compressed gas cylinder that can be activated in much the same way as discussed in relation to the blank cartridge. In other embodiments, an electronic triggering system can be utilized. In this example, an electronic switch (shown schematically for exemplary purposes at 80*b* in FIG. 13) can be provided within the launcher. Contact pad 80*a* can be provided on the casing (shown schematically for exemplary purposes at 80*b* in FIG. 9) on the launcher. A complementary pad (not shown) can be associated with the launcher. Activation of the triggering panel 46 can activate the electronic switch, which can then generate an electronic signal that can be transferred to the projectile casing through pad 80*a* to thereby cause activation of the pressure source. Pad 80*a* can ensure that the electronic signal cannot be provided to the casing unless the casing is properly installed within the launcher.

By packaging the pressure source 50 and the entangling projectile 12 in the removable projectile casing 44, all of the components that generate force (and react to force) are contained in a single unit. There are no unnecessary gaps or connections between the power source and the entangling projectile. This aspect also eliminates any need to reload two parts, the entangling projectile and the pressure source, as these are contained within one removable part, the projectile casing, which can be easily and quickly loaded into or unloaded from the launcher 42.

While much of the discussion above focused on the projectile casing and launcher used in the present technology, the ballistic features of the entangling projectiles must be carefully matched with the operable features of the casing and launcher. Generally, the entangling projectiles of the present technology are provided as electrically inert. That is, they are not attached to an electrical charge source, nor do they require an electrical charge to subdue or entangle a subject. As used herein, the term "electrically inert" is understood to refer to a condition in which the projectiles, and pellets and tether, do not carry an electrical charge other than that carried by inert objects within the environment in which the projectiles are deployed. Thus, while some static charge may be carried by most objects in such an environment, the projectiles (pellets and tether) do not carry any additional charge. In most embodiments, the tether and pellets similarly need not carry any other structure capable of delivering an electrical charge to a subject.

FIGS. 14 through 17 illustrate further exemplary embodiments of the present technology. In these examples, an entangling projectile 12*a* is shown for use with a projectile deployment system. The entangling projectile can include a pair of pellets (only one of which is shown in this view, pellet 14*a*). The at least one of the pair of pellets can include a head 120 with a head outer diameter "DH." A shank 122 can extend away from the head and can include a shank outer diameter ("Ds" in FIG. 16). The shank outer diameter is generally less than the head outer diameter. A tether 16 can connect the pellet 14*a* to its corresponding pair (not shown in this view).

A shroud 124 can be fitted about the shank 122 of the at least one 14*a* of the pair of pellets. The shroud can have a tether opening 126 (FIGS. 15 and 16) formed therein to receive the tether 16. Generally, the tether is coupled to the pellet (in the examples shown, it is coupled through and to the shank 122) and can extend along the shank of the pellet and through the tether opening formed in the shroud. The shroud serves to stabilize the pellet within a bore of a socket into which the pellet is loaded for deployment (for example, sockets 30*a*, 30*b*, discussed above). The boundary of a socket is shown for example by indicators 130 in FIG. 14, which generally define a diameter DB of the bore of the socket. By forming the shroud symmetrically about the pellet, the shroud also serves to maintain the shank 122 of the pellet centered within the bore of the socket.

For a variety of reasons, some of which were discussed above, it is desirable to provide a pellet 14*a* that includes a shank 122 having a diameter less than a diameter of the head 120. The present inventor, recognizing this, has provided a variety of improvements to the art that include this feature. However, it has been theorized that providing such a shank can possibly lead to instabilities in the resultant flight of the pellet as it is discharged from the projectile deployment system. The present shroud serves to stabilize the pellet as it travels along and out of a particular socket, resulting in a more stable, predictable and repeatable trajectory. The tether opening 126 also serves to restrain and position the tether relative to the pellet during storage and deployment of the pellet.

FIG. 10 illustrates an exemplary embodiment in which the pellets 14*a*, 14*b* each include a shroud 124*a*, 124*b*, respectively, coupled thereto. It can thus be seen that, once the pellets are installed within sockets 30*a*, 30*b*, respectively, the shrouds aid in maintaining the pellets centered within the sockets. In this particular embodiment, the hook assemblies 180*a*, 180*b* include hooks that collectively present a larger diameter than an inside diameter of the sockets 30*a*, 30*b*. As such, the hooks are designed to be prevented from entering into the sockets and are thus unable to provide a centering force within the sockets. The shrouds can serve to nonetheless maintain the pellets centered within the sockets.

While the shroud 124 can be formed from a variety of materials and in a variety of configurations, in one embodiment, the shroud can be formed of relatively lightweight but rigid fiberboard, polymer, paper, pressboard (e.g., fibrous materials), etc. The shroud 124 can include an outer diameter that is substantially equal to the head outer diameter and thus that is substantially equal to an inner diameter of a bore of a socket (30, 30*b*, for example, the bore of which is shown by example at 130 in FIG. 14). Thus, while not so limited, in one embodiment the shroud includes a generally rounded or circular outer surface, broken only by the tether opening 126. In one embodiment, a diameter of the shroud can be at least five times a thickness ("t" in FIG. 17) of the shroud. The thickness of the shroud can be around 1-5 mm. An overall length of the pellet is generally on the order of 1.5 inches (3.81 cm). Thus, the shroud is much thinner than an overall length of the pellet.

In this manner, the shroud 124 can be formed from a relatively inexpensive and readily available material, and can add very little weight or expense to the pellet. Due to the ease with which the shroud can be installed upon the shank 122, the added manufacturing burden is also very minimal. Such materials are generally lightweight but sufficiently rigid to serve the function desired.

The shroud 124 can be fitted about the shank 122 in a location displaced from the head 120 of the pellet. In one example, a space or opening generally devoid of material (132*a*, 132*b*, respectively, in FIG. 10) is thereby defined adjacent the shank between the shroud and the head of the pellet. While not so limited, the space in some embodiments includes a length about half that of the pellet: that is, the shroud is positioned about halfway along an overall length of the shank leaving an open space between the head and the shroud in this area. The space or opening provides room to adjust the shroud along the shank relative to the position of the head of the pellet.

Spacing the shroud from the pellet head can improve the stability of the pellet as it travels through the socket, without adding significant weight or complexity to the pellet arrangement. In one example, the shroud can frictionally engage the shank so as to be restrained from moving relative to the shank. This can be achieved by sizing the bore of the shroud slightly smaller than the outer diameter of the shank and pressing the shroud over the shank. Due to the lightweight material used, however, the press fit of the shroud about the shank can be relatively easily overcome by an operator to allow easy adjustment of a position of the shroud along the shank. Thus, the shroud is restrained from moving along the shank, but can be moved when desired by application of sufficient force.

While not shown in the exemplary figures, the shroud can include a split or partition that allows the shroud to be installed over the shank, without requiring that the shroud be slid over an end of the shank. In other words, the split or partition can be separated slightly to allow the shroud to be installed over the shank, after which the shroud will return to its nominal configuration, as shown.

The tether opening 126 can take a variety of forms. In the example shown in FIG. 15, the opening generally includes a "V-shaped" notch that can be relatively easily and inexpensively formed in the shroud. In the example shown in FIG. 16, the opening 126 includes a planar edge with the material of the shroud removed at and beyond said edge. Other configurations are also contemplated, including rounded cutouts or notches, etc. Generally, however, the tether opening is larger than a diameter of the tether, to enable the tether to be secured within the tether opening while the shroud is fitted within the bore of a socket. Thus, when viewed along an axis of a socket, the shroud consumes or blocks all of the area around the shank except for the space defined by the tether opening. This space is partially filled with the tether extending through the opening. The tether opening generally defines a space that is larger than an outer diameter of the tether.

Figure 18A:
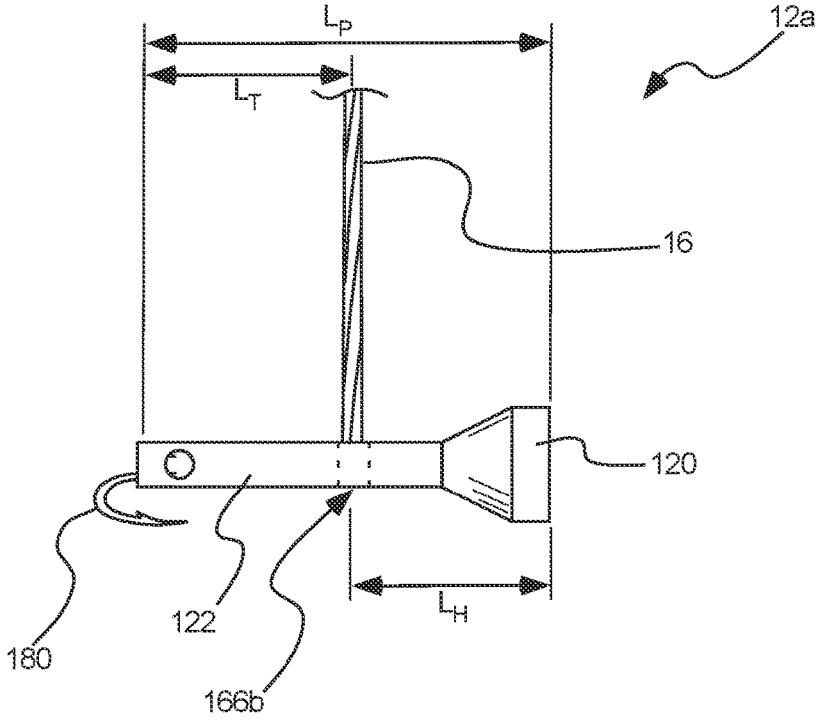
FIG. 18A is a side view of a portion of an entangling projectile in accordance with another embodiment of the invention.
Figure 18B:
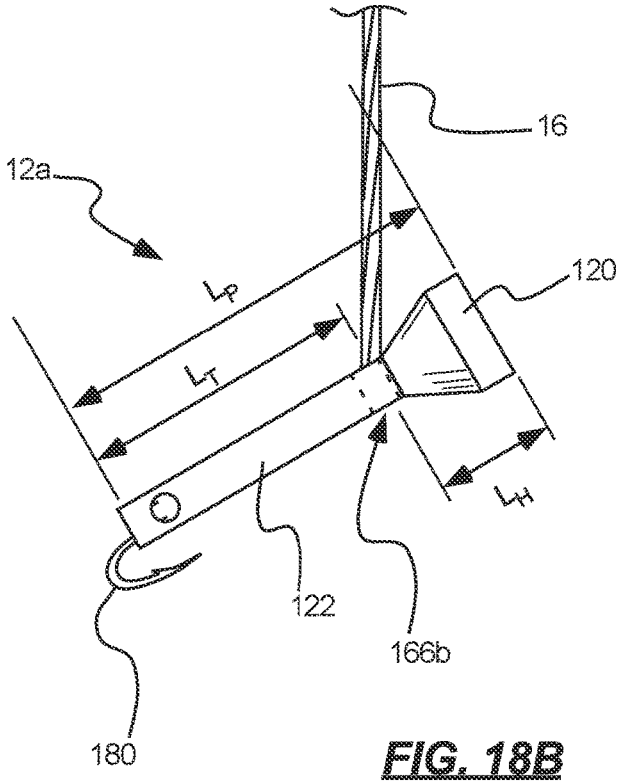
FIG. 18B is a side view of a portion of an entangling projectile in accordance with another embodiment of the invention, shown with the tether coupled to a shank of the pellet at a location longitudinally displaced along the shank.

FIGS. 18A and 18B illustrate a further embodiment of the technology in which a location at which tether 16 is coupled to pellet 12*a* is chosen and/or adjusted to achieve a desired mass balance. In the example shown in FIG. 18A, the pellet 12*a* includes a head portion (defined here by a length "$L_H$") and a tail portion (defined here by "$L_T$"). Generally, a combined length of the head portion and tail portion equates to an overall length of the pellet "$L_P$." The head portion can include head 120, and the tail portion can include at least one hook assembly 180 attached thereto. The hook assembly can include one or more individual hooks that can engage clothing of a subject engaged by the entangling projectile. The hooks can take the curved configuration shown, or can include spikes, angled barbs, etc. Tether 16 is coupled to shank 122 at an attachment location that divides the pellet into the head portion and the tail portion. In this example, the attachment location is access hole 166*b*.

In the example shown in FIG. 18A, the tail portion and the head portion are substantially weight balanced: if the pellet 12*a* is suspended from the tether 16 (that is, it is allowed to hang freely from the tether), the pellet will reach an equilibrium state wherein the head portion and tail portion are substantially parallel to one another. As will be appreciated, however, if the location of the access hole 166*b* is moved longitudinally along the pellet, the mass balance of the head and tail portions is altered. For example, as shown in FIG. 18B, if the location of the access hole is adjusted further toward the head 120, the tail portion of the pellet will have a greater mass than it previously had (which was previously about the same as the mass of the head portion). In this case, the tail portion will hang beneath the attachment point 166*b* and the head portion will extend above the attachment point.

The present inventor has found that adjusting a mass balance of the head portion relative to the tail portion can affect the efficiency and repeatability with which the pellet engages a subject. In the examples shown, after the pellet is propelled from a launcher, the head portion and tail portion will reach an equilibrium, analogous to those positions shown in FIG. 18A or 18B (except that the tether will generally be horizontal instead of the vertical orientation shown, as both the tether and the pellet are traveling very rapidly toward the subject). If the hook assembly 180 is positioned too near the tether 16 when the pellet engages a subject, the hook assembly may be less likely to successfully engage the subject's clothing. By adjusting the weight balance of the pellet so that the tail portion has a greater mass than does the head portion, the tail portion tends to hang or be suspended further from the tether. This can ensure a greater likelihood that the hook assembly engages the subject's clothing.

The mass balance or relationship between the tail portion and the head portion of the pellet can be adjusted, controlled or selected in a number of manners. For example, in the case described and shown with respect to FIGS. 18A and 18B, a location along the shank 122 at which the tether is connected can be adjusted to effectively change a length of the tail and head portions. Note, for example, that the length $L_T$ of the tail portion is smaller in the example of FIG. 18A than in FIG. 18B, while the length $L_H$ of the head portion is greater in that example. In addition to changing a physical location of the attachment point 166*b* to affect a mass balance of the pellet, other physical attributes of the pellet can be modified. For example, the same attachment point location can be used, but the head or tail portion can be made larger or smaller in diameter (or relatively longer or shorter). Materials of varying density can also be utilized, such that relative sizes and shapes of portions of the pellet can be maintained while making the portions heavier or lighter. Combinations of these techniques can also be utilized, as would occur to one of ordinary skill in the art having possession of this disclosure.

Figure 19:
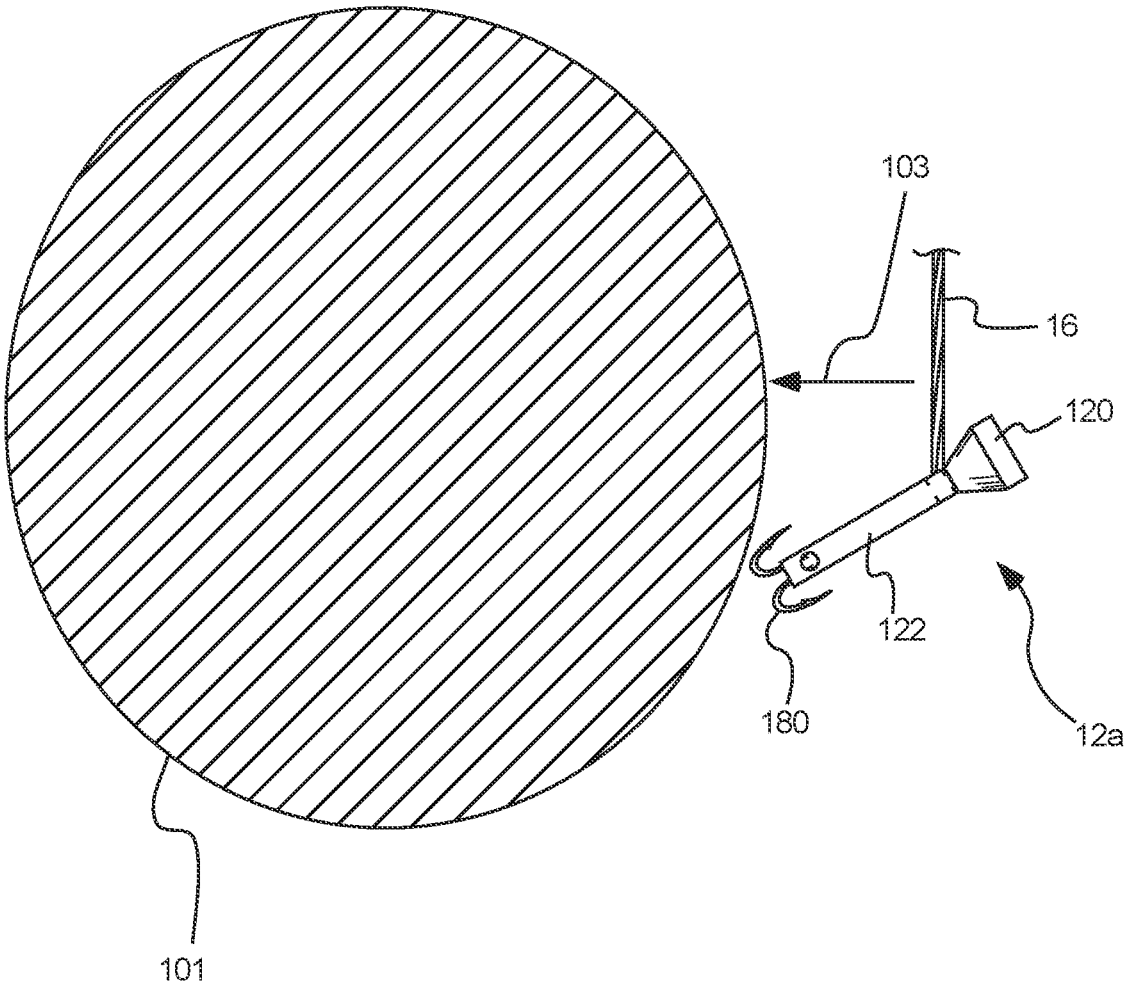
FIG. 19 is a top view showing a section of a leg of a subject and a portion of an entangling projectile immediately prior to a pellet of the projectile contacting the subject's leg.

FIG. 19 illustrates one example of the manner in which the pellet 12*a* of FIG. 18B appears immediately prior to engaging a subject. FIG. 19 includes a top view of a section of a subject's leg 101. In the example shown, only a single pellet 12*a* is illustrated, it being understood that generally two pellets will be wrapping about one or both of the subject's leg. The direction of travel of the pellet is illustrated by directional indicator 103. At this point in flight, the tether 16 will be pulled substantially taught. It will be appreciated that "mass balancing" the pellet, as described in relation to FIG. 18B, results in the tail end of the pellet (which includes hook assembly 180) to travel ahead of the tether 16, while the head end 120 trails behind the tether. This results in the hook(s) of the hook assembly 180 first making contact with the subject's leg (or torso, or arm, as the case may be). This results in a much higher rate of successful engagement than if the head contacts the subject first, or if the head and the tail contact the subject at substantially the same time.

In addition to the structure described above, the present technology also provides a method of attaching a tether to a pellet of an entangling projectile, the method comprising: defining an attachment point on the pellet to thereby divide the pellet into a tail portion and a head portion; determining a mass of the tail portion and of the head portion; adjusting a location of the attachment point along a longitude of the pellet to thereby change a size of the tail portion and head portion until the mass of the tail portion is greater the mass of the head portion; and attaching the tether to the pellet at the adjusted attachment point.

The present technology also provides a method of attaching a tether to a pellet of an entangling projectile, the method comprising: defining an attachment point on the pellet to thereby divide the pellet into a tail portion and a head portion; determining a mass of the tail portion and of the head portion thereby defined; adjusting a mass of the tail portion and the head by adjusting one of i) a size, ii) a shape and iii) a material of the tail portion and the head portion until the mass of the tail portion is greater the mass of the head portion; and attaching the tether to the pellet at the attachment point. The present technology also provides a method of loading an entangling projectile within a projectile launcher, the method comprising: obtaining an entangling projectile, the entangling projectile including: a pair of pellets, each of the pair of pellets having: a head with a head outer diameter; a shank with a shank outer diameter, the shank outer diameter being less than the head outer diameter; a shroud, fitted about a shank of each of the pair of pellets, the shroud having a tether opening formed therein to receive the tether; and a tether connecting the pair of pellets. The method can include positioning each of the pair of pellets within one of a pair of sockets associated with the projectile launcher such that head of each pellet is positioned upstream of the shank and the shroud is positioned downstream of the head with the tether fitted within the tether opening of the shroud and extending out of the socket.

In this arrangement, each of the pellets can include a hook assembly carried by an end of the pellet distal from the head of the pellet. One or more hooks of the hook assembly can be positioned outside of the socket. The hook assemblies can include an outer diameter that is greater than an inner diameter of the socket. This relationship is shown in, among others, FIGS. 10 and 14-16.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

The invention claimed is:

1. An entangling projectile for use with a projectile deployment system, the entangling projectile comprising:
- a pair of pellets, at least one of the pair of pellets having:
  - a head with a head outer diameter; and
  - a shank with a shank outer diameter, the shank outer diameter being less than the head outer diameter;
- a tether connecting the pair of pellets; and
- a centering shroud, carried by a shank of the at least one of the pair of pellets, the centering shroud having at least one tether opening formed therein to receive the tether, the tether being coupled to the pellet and extending along the shank of the pellet and through the at least one tether opening formed in the centering shroud.

2. The entangling projectile of claim 1, wherein the centering shroud is coupled to and extends outwardly from the shank of the pellet.

3. The entangling projectile of claim 1, wherein the centering shroud includes an outer diameter substantially equal to the head outer diameter.

4. The entangling projectile of claim 1, wherein the centering shroud is carried by the shank in a location displaced from the head of the pellet, with an open space defined adjacent the shank between the centering shroud and the head of the pellet.

5. The entangling projectile of claim 1, wherein the centering shroud includes a plurality of tether openings formed therein.

6. The entangling projectile of claim 5, wherein at least one of the tether openings includes a V-shaped notch.

7. The entangling projectile of claim 1, wherein the centering shroud is formed symmetrically about the shank.

8. A method of loading an entangling projectile within a projectile launcher, the method comprising:
- obtaining an entangling projectile, the entangling projectile including:
- a pair of pellets, each of the pair of pellets having:
  - a head with a head outer diameter;
  - a shank with a shank outer diameter, the shank outer diameter being less than the head outer diameter;
  - a shroud, coupled to a shank of each of the pair of pellets, the shroud having a tether opening formed therein to receive the tether; and
- a tether connecting the pair of pellets; and positioning each of the pair of pellets within one of a pair of sockets associated with the projectile launcher such that the head of each pellet is positioned upstream of the shank and the shroud is positioned downstream of the head with the tether fitted within the tether opening of the shroud and extending out of the socket.

9. The method of claim 8, wherein the shroud is coupled to and extends radially outwardly from the shank of the pellet.

10. The method of claim 8, wherein the shroud includes an outer diameter substantially equal to the head outer diameter.

11. The method of claim 8, wherein the shroud is carried by the shank in a location displaced from the head of the pellet, with an open space defined adjacent the shank between the shroud and the head of the pellet.

12. The method of claim 8, wherein the shroud includes a plurality of tether openings formed therein.

13. The method of claim 12, wherein at least one of the plurality of tether openings includes a V-shaped notch.

14. The method of claim 8, wherein the shroud is formed symmetrically about the shank.

* * * * *